United States Patent [19]

Raab

[11] 4,262,798

[45] Apr. 21, 1981

[54] CARRYING CASE

[75] Inventor: Clifford G. Raab, Huntington Beach, Calif.

[73] Assignee: Michael K. Lewin, Manhattan Beach, Calif. ; a part interest

[21] Appl. No.: 778,572

[22] Filed: Mar. 17, 1977

[51] Int. Cl.[3] ..... A45C 11/24; B65D 85/00

[52] U.S. Cl. ..... 206/315 R; 150/52 G

[58] Field of Search ..... 273/74; 150/52 R, 52 A, 150/52 G; 220/22, 22.3; 206/315 R, 315 B, 579, 563, 564

[56] References Cited

U.S. PATENT DOCUMENTS

| | | | |
|---|---|---|---|
| 1,541,895 | 6/1925 | Blair | 273/74 |
| 2,533,577 | 12/1950 | Godfrey | 206/315 |
| 2,929,530 | 3/1960 | Sargent | 220/22 |
| 3,138,306 | 6/1964 | Bare | 206/315 |
| 3,490,169 | 1/1970 | Tweed | 206/315 |

FOREIGN PATENT DOCUMENTS

| | | | |
|---|---|---|---|
| 1381537 | 10/1963 | France | 150/52 A |
| 1565476 | 5/1969 | France | 206/315 B |
| 342412 | 2/1931 | United Kingdom | 273/74 |

*Primary Examiner*—Herbert F. Ross
*Attorney, Agent, or Firm*—Harvey S. Hertz

[57] ABSTRACT

A carrying case having a pair of opposed base members each having a parallel spaced apart wall when said case is closed. Lip members associated with each wall are formed in planes intersecting the walls respectively. The walls and the lip member defining an enclosed department. A rib member is secured to one of the walls and is formed in a plane perpendicular thereto. The rib member abuts the other wall when the case is closed.

2 Claims, 4 Drawing Figures

CARRYING CASE

BACKGROUND OF THE INVENTION

1. Field of the Invention

The field of art to which the invention pertains includes the field of carrying cases, particularly, with respect to a carrying case which contains a built-in support extending the height of the case for preventing crushing of the case opposed walls.

2. Description of the Prior Art

Conventional carrying cases utilize the structure of the wall to prevent crushing thereof. It has been found that when an item is carried in the interior of the case, the large wall expanse enables some flexing to occur which can damage items contained in the carrying case. Where the item in the case is a piece of sports equipment or other instrument, it is necessary to provide large amounts of additional support material in the carrying case which adds both weight and bulk to the case and minimizes the useable space therein.

Known prior art includes U.S. Pat. Nos. 3,931,967; 3,604,706; 3,079,156; 2,767,758; 1,620,072; and 2,270,049.

The present invention provides a rib member which is positioned between the opposed parallel walls of a carrying case and defines an outline of the device to be carried therein. The rib member prevents the opposed walls from collapsing onto the device being carried in the carrying case while minimizing the amount of space utilized for support.

SUMMARY OF THE INVENTION

A carrying case having a pair of opposed base members each having spaced apart walls when the case is closed. Lip members are formed in planes intersecting the walls respectively. The walls and the lip members define an enclosed department. A rib member is secured to one of the walls and is formed in a plane perpendicular thereto. The rib member also abuts the other wall when the case is closed.

The advantages of this invention, both as to its construction and mode of operation, will be readily appreciated as the same becomes better understood by reference to the following detailed description when considered in connection with the accompanying drawings in which like reference numerals designate like parts throughout the Figures.

DESCRIPTION OF THE PREFERRED EMBODIMENTS

Figure 1:
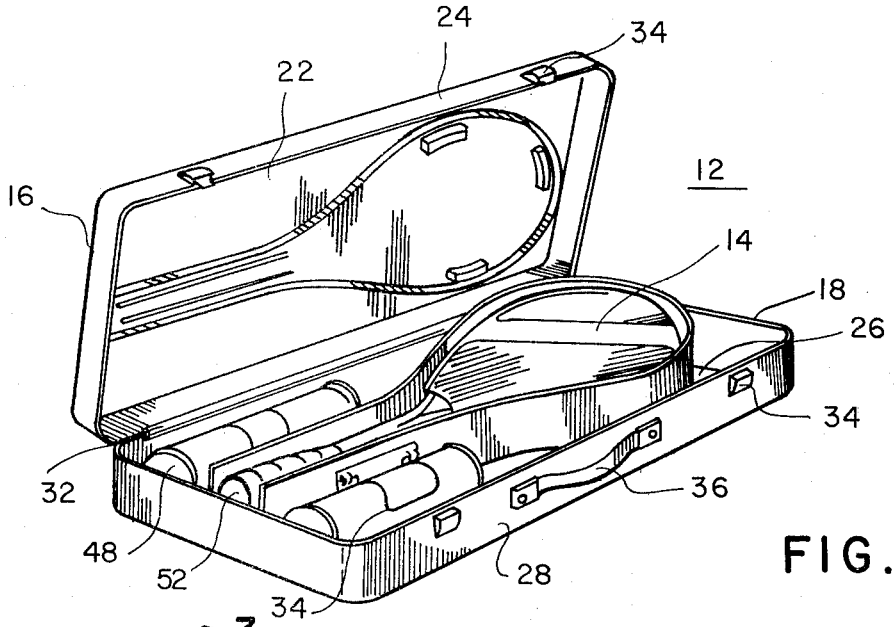
FIG. 1 is a perspective view of a carrying case in an open position illustrating the present invention.

Referring now to the drawings, there is shown in FIG. 1 a carrying case 12 constructed in accordance with the principles of the invention and illustrated to store at least one tennis racquet 14 therein. The carrying case is formed of an upper base 16 and a lower base 18 typically formed of molded plastic although it should be understood that any other material such as leather or metal could be utilized as well.

The upper base 16 is formed of a top wall 22 of generally rectangular configuration having a downwardly extending lip 24 integral therewith along the top wall perimeter. Similarly, the lower base 18 is formed of a bottom wall 26 whose dimensions are similar to that of the top wall 24. An upwardly extending lip 28 is formed along the periphery of the bottom wall 26 and is integral therewith. When the carrying case 12 is closed, the free ends of the downwardly extending lip 24 and the upwardly extending lip 28 mate with each other to form an elongated housing.

A hinge 32 is secured to one edge of adjacent carrying case lips enabling the case 12 to be opened as shown in FIG. 1. Additionally, retaining clips 34 are secured to the opposite side edge of the hinged lip portions enabling the case to be secured when closed. A carrying case handle 36 is secured to the outer surface of the upwardly extending lip 28 intermediate the clips 34 enabling the case 12 to be carried when in a closed position.

Figure 2:
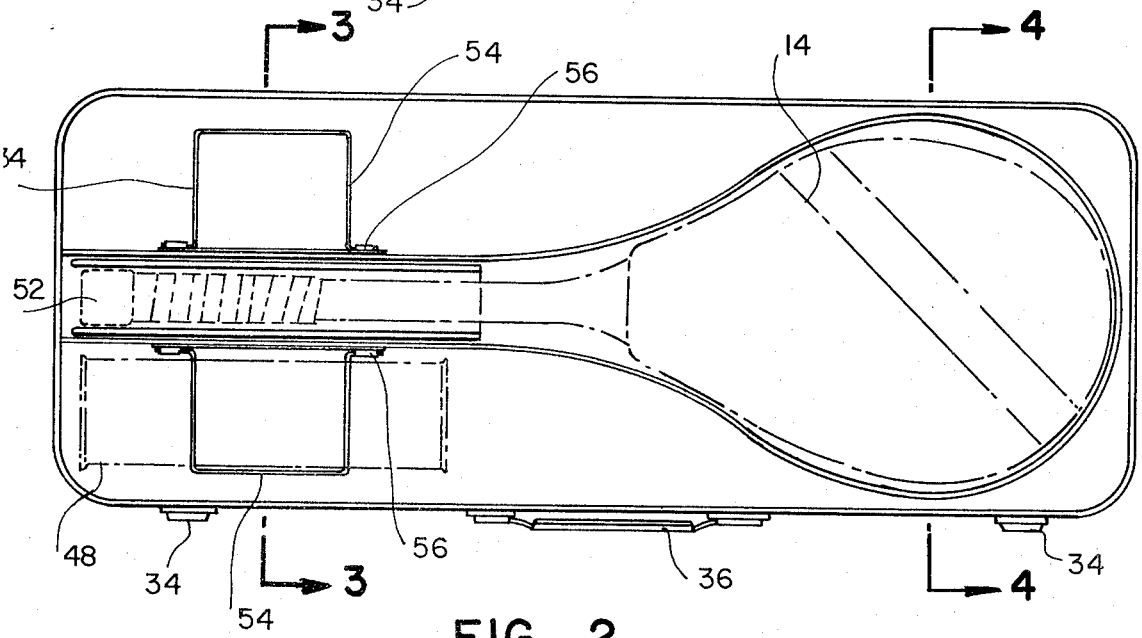
FIG. 2 is a top plan view of the lower base of a carrying case of FIG. 1.

A continuous rib member 38 is secured to the interior surface of the bottom wall 26 with its lower edge being fastened in a ridge 42 (FIG. 3) which extends outwardly beyond the outer surface of the bottom wall 26. Typically, the continuous rib member 38 is formed of molded plastic and shaped to an outline slightly greater than that of the tennis racquet 14 as shown more clearly in FIG. 2. The lower edge of the rib member 38 is normally glued into the interior surface of the ridge 42 so that it is permanently affixed to the interior surface of the bottom wall 26. Similarly, a top wall ridge 44 is formed in the carrying case top wall 22 and extends above the top wall exterior surface (FIG. 4). Thus, as can be seen in FIG. 4 when the carrying case is in a closed position, the continuous rib member 38 free edge is positioned so that it abuts the interior of the top wall ridge 44.

Referring again to FIG. 1, a plurality of foam inserts are affixed to the interior surface of the top wall 22 intermediate the area defined by the continuous rib 38. The foam inserts 46 provide a cushion so that the top surface of the tennis racquet 14 abuts the inserts 46 (FIG. 4) when the case 12 is closed. Similar inserts could be provided on the interior surface of the bottom wall 26.

A can of tennis balls 48 is positioned abutting the interior bottom wall 26 on respective opposite sides of the continuous rib member non-adjacent surfaces formed where the continuous rib member is on opposite sides of the tennis racquet handle 52. A hinged U-shaped retaining clip 54 is secured at its free ends by means of securing plates 56 to the non-adjacent surfaces of the continuous rib member 38 in the vicinity of the tennis racquet handle 52. The retaining clips pivot so that the cans 48 can be removed when needed.

Figure 3:
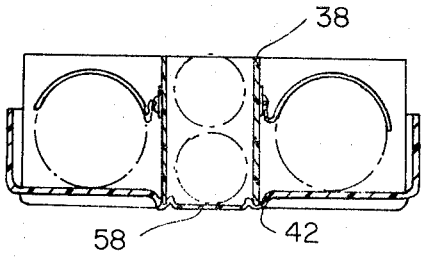
FIG. 3 is a cross-sectional view of the carrying case taken along the line 3—3 of FIG. 2.
Figure 4:
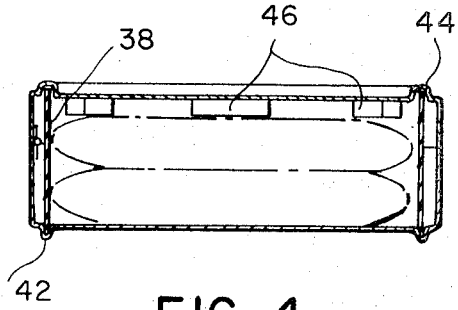
FIG. 4 is a cross-sectional view of the carrying case taken along the line 4—4 of FIG. 2 with the case in a closed configuration.

As the height of the tennis racquet 14 is greater at the handle 52 than it is adjacent the remainder of the tennis racquet, a recess 58 of the top and bottom walls 22 and 26 intermediate the upper and lower ridges 44 and 42 respectively, can be tapered so that it extends outwardly from the carrying case a distance really equal to that of the ridges (FIG. 3). Thus, a plurality of tennis racquets can be carried in the case without increasing the height of the case and thus minimizing the thickness thereof. Such a design facilitates transportation of the carrying case enabling it to be easily positioned beneath an airline seat or otherwise when transporting the case.

When the case 12 is closed in the position shown in FIG. 4, the continuous rib member 38 prevents a force being applied to the top or bottom exterior surfaces of the top wall 22 or the bottom wall 26 which can damage the tennis racquets 14. The rib member 38 will absorb such forces and prevent the top and bottom walls from crushing.

While the carrying case has been illustrated for use with a tennis racquet, it should be understood that the case could also be used to carry almost any other type of equipment—sports or otherwise—of estimated shape which must be protected against accidental damage.

I claim:

1. A carrying case comprising:

a pair of opposed base members each having a parallel spaced apart wall when said case is closed, and lip members formed in planes intersecting said walls respectively, said walls and said lip members defining an enclosed compartment; and a rib member secured to one of said walls and formed in a plane perpendicular thereto and abutting said other wall when said case is closed, said rib member being spaced from said lip member in the interior of said compartment in a plane generally parallel thereto, said walls containing ridges formed in planes perpendicular to said walls, said ribs and said ridges extending beyond the plane of the outer surface of said walls, the edges of said rib member being positioned in said ridges.

2. A carrying case in accordance with claim 1 wherein said ridges define an outline of a piece of equipment having dimensions slightly greater than the exterior dimensions of said equipment for enabling said equipment to be inserted in said carrying case intermediate said outline.

* * * * *